US008272330B1

(12) United States Patent
Gold et al.

(10) Patent No.: US 8,272,330 B1
(45) Date of Patent: Sep. 25, 2012

(54) SELECTABLE SIZE FRAGMENTATION WARHEAD

(75) Inventors: Vladimir M. Gold, Hillside, NJ (US); Jeffrey R. Kraft, Newton, NJ (US); Ernest L. Baker, Wantage, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 127 days.

(21) Appl. No.: 12/709,534

(22) Filed: Feb. 22, 2010

(51) Int. Cl.
*F42B 12/22* (2006.01)
*F42B 12/28* (2006.01)

(52) U.S. Cl. ..... 102/494; 102/492; 102/475

(58) Field of Classification Search ..... 102/491, 102/492, 493, 494, 495, 506, 475
See application file for complete search history.

(56) References Cited

U.S. PATENT DOCUMENTS 3,491,694 A * 1/1970 Fountain ..... 102/493
3,566,794 A * 3/1971 Pearson et al. ..... 102/493
3,741,123 A * 6/1973 Dittrich ..... 102/491
4,305,333 A * 12/1981 Altenau et al. ..... 102/306
4,312,274 A * 1/1982 Zernow ..... 102/493
5,337,673 A * 8/1994 Koontz et al. ..... 102/491
6,857,372 B2 * 2/2005 Renaud-Bezot et al. ..... 102/493
7,886,667 B1 * 2/2011 Baker et al. ..... 102/495
8,061,275 B1 * 11/2011 Gold ..... 102/495

* cited by examiner

*Primary Examiner* — James Bergin
(74) *Attorney, Agent, or Firm* — Michael C. Sachs

(57) ABSTRACT

A fragmentation warhead includes a cylindrical body, a pair of concentric cylindrical liners made of plastic, and an explosive charge disposed within the innermost liner. The innermost liner includes patterns formed thereon of recessed areas and solid liner elements. The outermost liner's interior surface includes patterns formed thereon of raised areas and solid liner elements. The outermost cylindrical liner is arranged to be adjustable relative to the innermost liner through rotation or translation. The explosive charge is disposed adjacent to the interior of the innermost cylindrical liner. Upon detonation of the explosive charge and because of the random dampening and temporal delay in transmitting the detonation energy through various locations of the randomly aligned cylindrical liners, the warhead body is caused to shear and break into fragments with different sizes. It can be understood that adjustment of the outermost cylindrical liner can be used to influence the size of fragments ultimately generated when the warhead breaks apart through detonation.

9 Claims, 9 Drawing Sheets

SELECTABLE SIZE FRAGMENTATION WARHEAD

U.S. GOVERNMENT INTEREST

The inventions described herein may be made, used, or licensed by or for the U.S. Government for U.S. Government purposes.

BACKGROUND OF INVENTION

Warhead fragmentation effectiveness is determined by the number, mass, shape, and velocity of the fragments. By using a controlled fragmentation design, warhead fragmentation can generally be achieved quickly and cost effectively. Exemplary controlled fragmentation techniques are described in U.S. Pat. Nos. 3,491,694; 4,312,274; 4,745,864; 5,131,329, and 5,337,673.

In general, conventional designs use "cutter" liners that form fragments by generating a complex pattern of high-velocity "penetrators" for fragmenting the shell. Although these conventional fragmentation designs have proven to be useful, it would be desirable to present additional functional, cost and safety improvements that minimize the warhead weight, reduce manufacture expenses, and advance current United States Insensitive Munition (IM) requirements.

What is therefore needed is a controlled fragmentation technique through the use of patterned liners which introduce shear stress into the warhead body and creates the desired fragmentation patterns. Fragment size, fragment numbers, and patterns thereof may be influenced through novel liner configurations. The need for such a controlled fragmentation technique has heretofore remained unsatisfied.

SUMMARY OF INVENTION

The present invention satisfies these needs, and presents a munition or warhead such as a projectile, and an associated method for generating controlled fragmentation patterns. According to the present invention, warhead fragmentation is achieved more efficiently and more cost effectively than conventional techniques, through the use of relatively inexpensively formed plastic liners with a predetermined pattern of recessed areas, plastic liners with a predetermined pattern of raised areas, and plastic liners with a predetermined pattern of cutouts. According to the present invention, the "shear" and "stamp" liner recessed areas, raised areas, and cutouts, respectively can create contours of localized transitional regions with high-gradients of pressures, velocities, strains, and strain-rates acting as stress and strain concentration factors. Unstable thermoplastic shear (adiabatic shear) eventually transfers the entire burden of localized strain to a finite number of shear planes leading to a shell break-up and formation of fragments.

According to one embodiment of the present invention, the warhead includes liners that are disposed inside the warhead body (one of which liner may be manually positioned from outside the warhead) which include predetermined patterns that are created with areas of different overall thicknesses presented to the exploding core, such allowing the detonation shock wave to correspondingly propagate into the fragmenting case through various effective thicknesses of liner material. As a result, the explosion produces a complex pattern of shear planes in the warhead body, causing the case break-up and formation of fragments with various, predetermined sizes. This design is distinguishable from existing fragmentation liner technologies that attempt to score or cut the warhead body.

One of the advantages of the present embodiment compared to existing technologies is the cost effectiveness of the manufacturing process of the present design, in that it is faster and more economical to fabricate and to pattern plastic liners, as opposed to notching or cutting a steel warhead body itself. An advantage of the present invention is that the use of plastic material reduces the overall weight of the warhead compared with use of other materials. Fortuitously, the use of plastic is also a great safety feature. An unwanted ignition of the explosive due to the heat of launch would normally be catastrophic as well as fratricidal, but here the plastic liners in this invention cover(s) the explosive inside the casing body. In the event of unwanted heat/ignition, the plastic (which is also low melt temperature material), would melt to seal the explosive which adds to safety. Moreover the (melted) plastic would also flow and could push out overflows that are usually provided in these rounds. Because of the plastic, neither sudden pressure nor heat/ignition inside the round would therefore be as catastrophic. Therefore, choice of low-melt temperature plastic as liner materials in this invention, adds safety to the round. This benefit is favorable, consistent with current Insensitive Munition (IM) requirements in minimizing accidental ammunition explosion due to fire hazards.

OBJECTS OF THE INVENTION

It is therefore an object of the present invention to provide means for generating fragments upon detonation of a warhead, with a relatively less expensive to manufacture structure of plastic liner components, and;

It is a further object of the present invention to provide a fragmentation warhead which generates fragments upon detonation wherein the size and shape of such fragments may be selected through liner design, and;

It is a still further object of the present invention to provide a fragmentation warhead which generates fragments upon detonation wherein the size and shape of such fragments may be selected prior to detonation by manually dialing in a change to positioning of liner components within said warhead, and;

It is a yet another object of the present invention to provide a fragmentation warhead of increased safety and sensitivity against unwanted fratricide of other warheads by reason of melting properties of the plastic materials within the warhead providing protection there against.

These and other objects, features and advantages of the invention will become more apparent in view of the within detailed descriptions of the invention and in light of the following drawings, in which:

DETAILED DESCRIPTION

Figure 1:
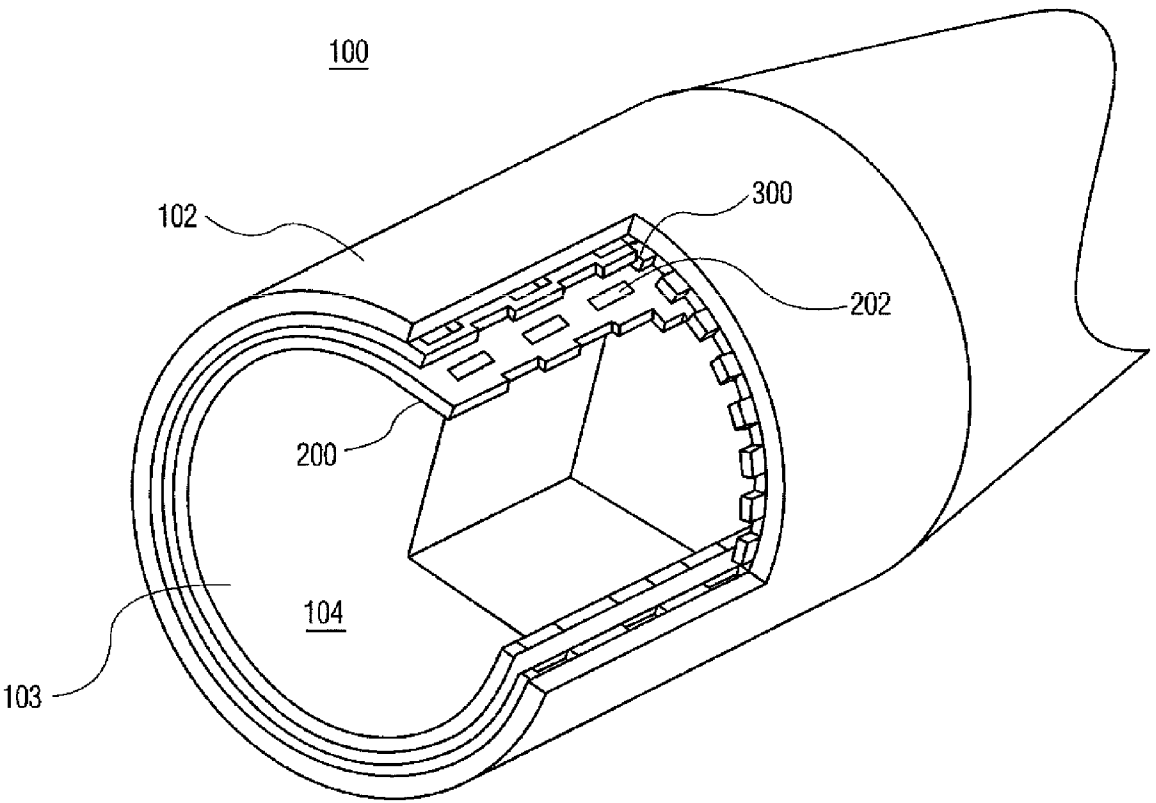
FIGS. 1 and 1A show a cutaway isometric view of a fragmenting warhead assembly according to this invention.
Figure 1A:
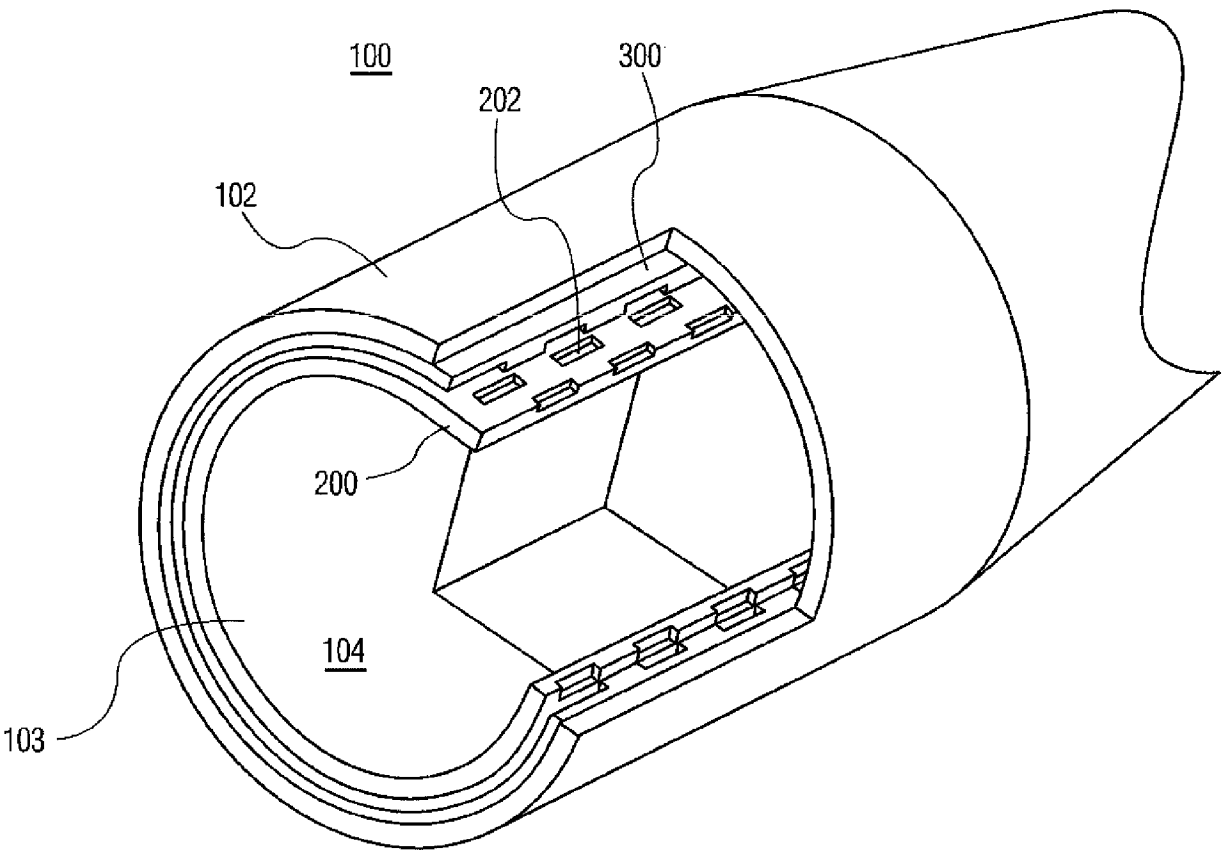

FIGS. 1, 1A illustrate an exemplary warhead, projectile, munition, explosively formed projectile, or shaped charge liner, etc., (referenced herein as warhead 100), utilizing liners 200 and 300 that are selectively patterned to effect control of fragmentation of a warhead body 102 according to the present invention. The warhead 100 generally comprises the body 102 that houses the liners, an explosive or explosive charge 104, back plates (not shown), and an initiation mechanism assembly (not shown). The warhead liners generally take the cylindrical shape of the warhead body 102. The explosive charge 104 comprises, for example, LX-14, OCTOL, hand packed C-4, or any other solid explosive, that can be machined, cast, or hand-packed to fit snugly within the inside of inner (stationary) liner 200. As further illustrated in more detail hereunder, a pattern of the liner 200 has recessed areas 202 and non-recessed areas 203, while the outer (adjustable) liner 300 has rectangular holes therein. The recessed areas and rectangular holes could be formed by any conventional method such as by stamping or by stereo lithography. The liners could be made of any suitable low-melt temperature material such as HDPE (High Density Poly Ethylene), or Accura SI 40 stereo lithographic material mimicking Nylon 6:6. Liner thickness could be approximately a fraction of a millimeter to several millimeters. It will be appreciated that the liners are made of a low melt-temperature plastic material to facilitate heat-induced melt out, further enhancing ammunition resistance to fire hazards wherein, in the event of unwanted heat or pressures of launch, the liner plastic melts and flows acting to seal the explosive from catastrophic fratricide, and further the melted plastic also tends to flow to exit the warhead to eliminate pressure within the body. The patterns described herein comprise openings, gaps, or cutouts (collectively referred to herein as gaps) that are interposed among a plurality of patterned liner solid areas. Upon detonation of the explosive charge 104 of the warhead 100, in the areas of liner recessed areas, the momentum of the shock wave propagating through the explosive 104 is transmitted more readily to analogous sections of the interior of the warhead body 102 by breaking through, as compared to breaking through the thicker, non-recessed areas, and then to those analogous sections of the interior of the warhead body 102.

The time delay between the moments when the shock waves arrive is determined by the differences between the detonation velocity of the explosive 104 and the shock wave propagation speed of liner material, in various thicknesses of the liner material, respectively. It can be appreciated that this generates a high gradient of pressures, velocities, and strains between parts of the liners, acting as stress and strain "concentration factors". Unstable thermoplastic shear (adiabatic shear) eventually transfers the entire burden of localized strain to a finite number of shear planes leading to the warhead body 102 break-up and formation of fragments. As a result, a predetermined pattern of liner recessed areas or non-recessed areas, whether or not lined up under a cutout area in outer liner 300, can "stamp out" a pattern of localized transitional regions so as to cause the warhead body 102 to shear and break into fragments with controlled sizes. The thinnest liner material presented to the explosion would be a recessed area 202 lined up under a rectangular hole in 300. Twice as much material would be a non-recessed area 203 lined up under a rectangular hole in 300 and three times as much material would be a non-recessed area 203 not lined up under a rectangular hole in 300.

Figure 2:
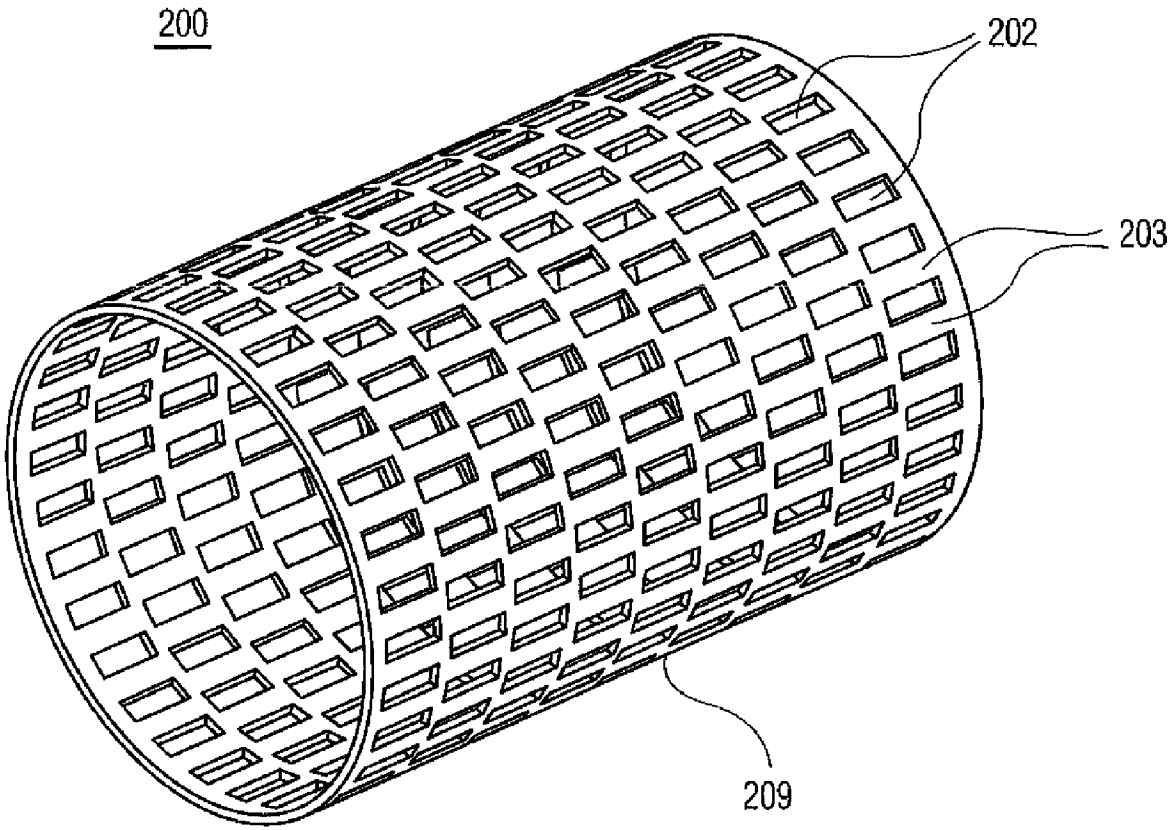
FIG. 2 shows an isometric view of the stationary liner 200 in one embodiment of the invention with a grid system of open gapped areas, that is internal to the fragmenting warhead of FIG. 1.
Figure 2A:
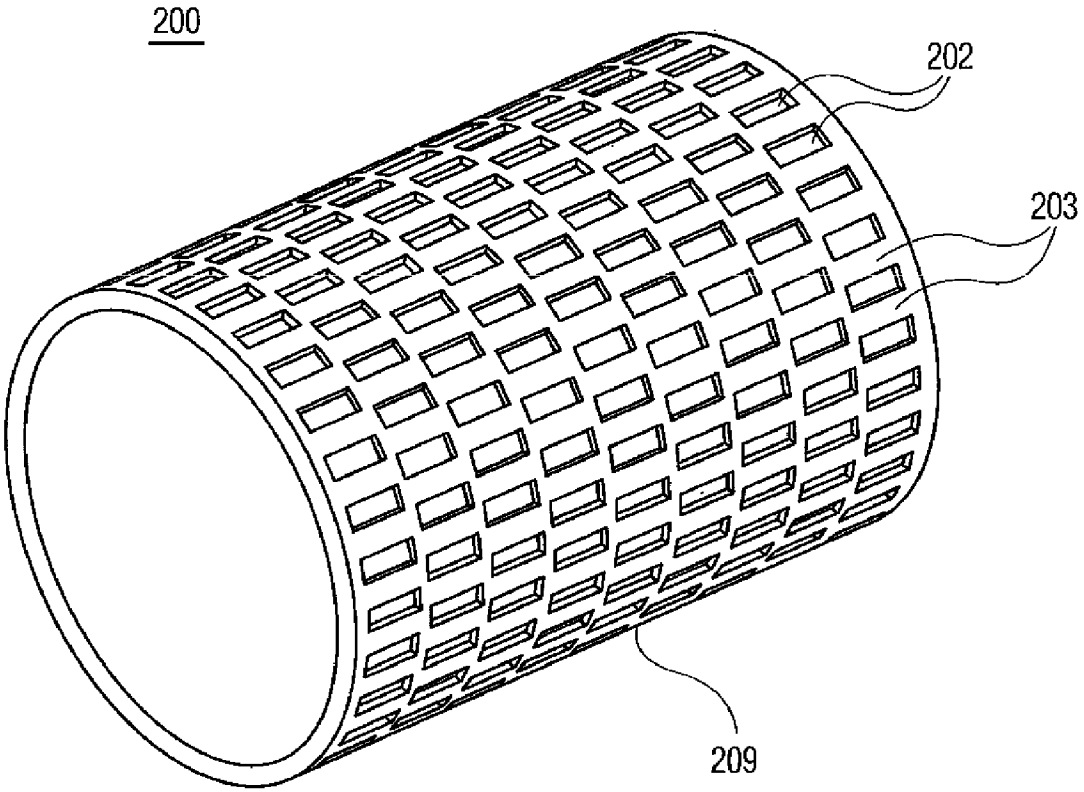
FIG. 2A shows an isometric view of the stationary liner 200 in another embodiment of the invention with a grid system of solid areas, and also of recessed areas, that is internal to the fragmenting warhead of FIG. 1A.
Figure 4A:
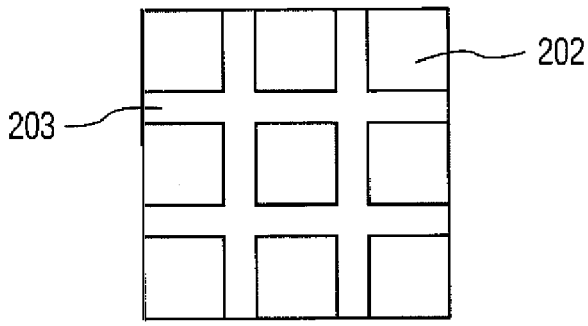
FIGS. 4A through 4C illustrate the effect of randomly possibly lining up open gaps of liner 300 of FIG. 1 directly over recessed areas in liner 200 of FIG. 2A, and in various other random positions of liner 300 with respect to liner 200.
Figure 4B:
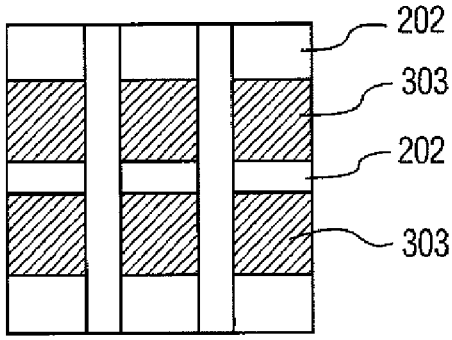
Figure 4C:
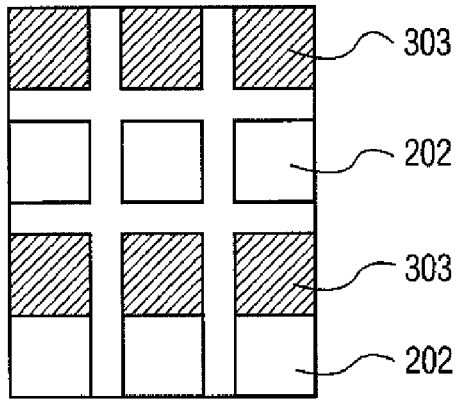
Figure 5:
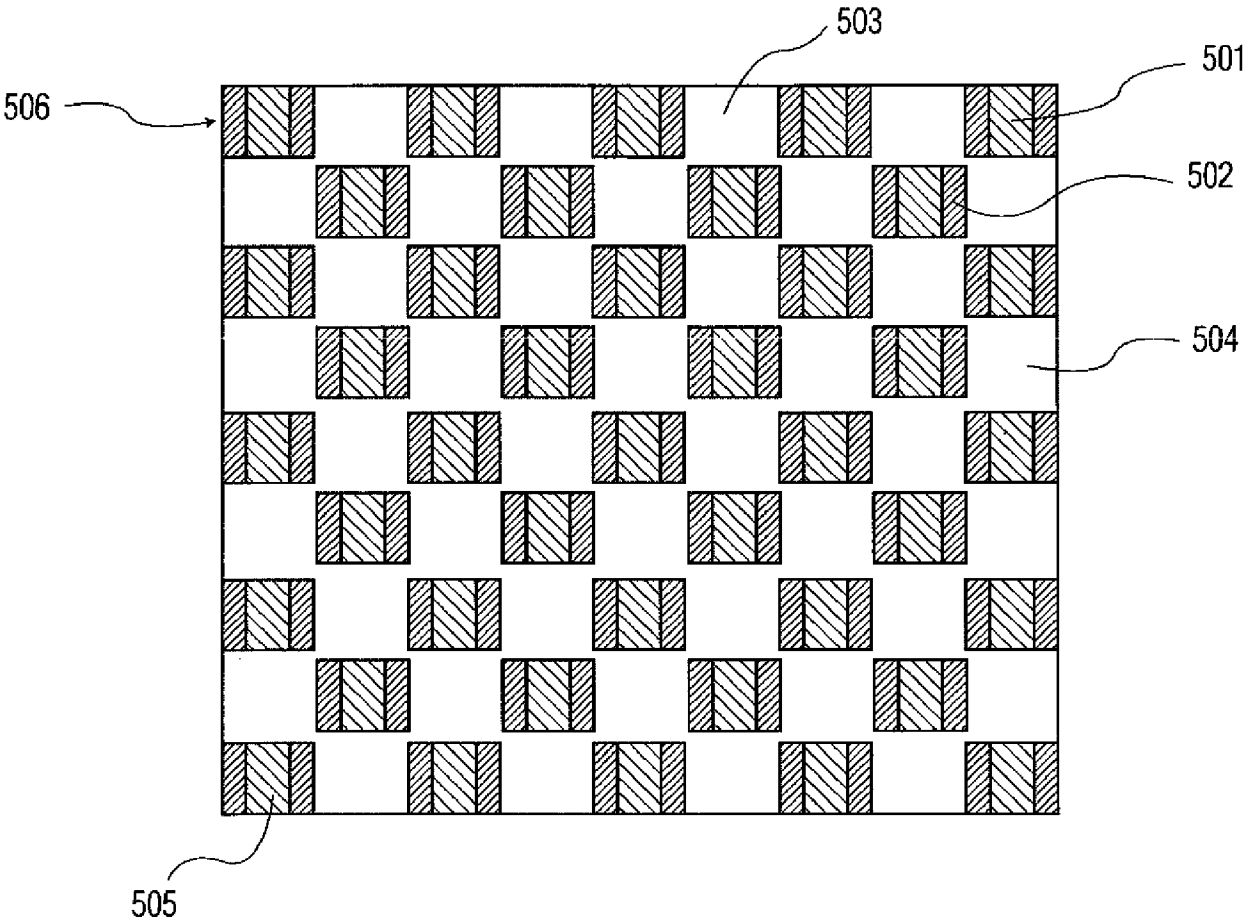
FIG. 5 illustrates the effect of lining up recessed areas of the liner of FIG. 2 through various ways of moving liner 300 of FIG. 1 relative thereto.
Figure 5A:
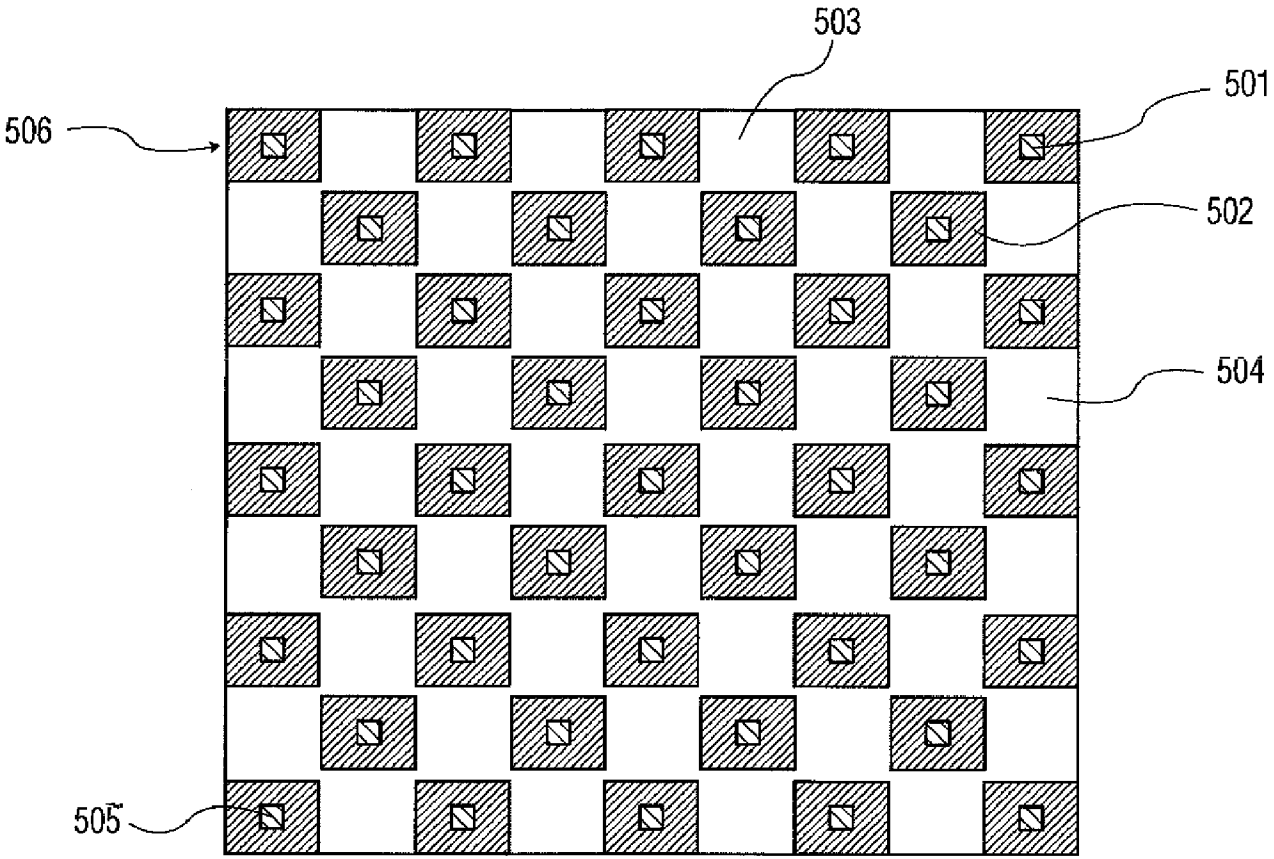
FIG. 5A illustrates the effect of lining up recessed areas of the liner of FIG. 2A through various ways of moving liner 300 of FIG. 1A relative thereto.

The thickness of a liner in various locations and type of explosive help determine the fragment results. A selectively controlled pattern of recessed areas (also here in called "gaps") can comprise sections of equal size or, alternatively, sections ranging in size from a relatively large size to smaller sections. The larger size of the intact (non-gap) sections is selected for more heavily armored targets, while the smaller size of intact (non-gap) sections is applicable for lightly armored or soft targets. Consequently, the pattern efficiently enables variable and selective lethality of the warhead 100 that can range from maximum lethality for more heavily armored targets to a maximum lethality for lightly armored or soft targets. FIG. 1A shows a cutaway view of the generally cylindrically shaped warhead 100. Shown through open end 103 of the warhead 100, is at the core, an explosive 104, surrounded by the also generally cylindrically shaped, stationary grid 200. As was described elsewhere, when explosive 104 detonates, the explosive pattern through open areas in adjustable grid 300 is different than at solid areas in liner 300. These differences in explosive patterns will ultimately lead to analogous fragments in the fragmenting warhead housing 102. (The respective sizes of the grids, warhead housing, thicknesses, lengths, and/or diameters are not exactly to scale in these drawings). Adjustable grid 300 is turned around from as currently depicted or slid back and forth in place (or some combination thereof), placed into the open end 103 of the warhead 100 shown in FIG. 1A, between the inside of housing 102 and surrounding the stationary grid 200, until knob 306 on grid 300 is flush to the end of warhead 100. The depth on lip 308 on knob 306 is kept short enough so that diameter of knob 306 generally is equal to outside diameter of warhead 100. Knob 306 preferably has gradation markings 307 to allow a soldier to dial in desired sizes for the fragments to be formed by the exploding fragmenting warhead housing 102. (Exact position for marked gradations 307 are learned through extensive trial and error in the manufacturing, testing and prove out processes). It must be noted that adjustable grid 300 may be pulled out or returned, pushed back in, in lateral movements, as well as rotated through the knob, in either clockwise or counter clockwise rotations. As will be further described, all these movements will have an ultimate influence on sizes for the fragments to be formed by an exploding fragmenting warhead housing 102. Although the overall length 309 of adjustable grid 300 shown here is essentially equal to length 209 to that of stationary grid 200 of FIG. 2A, the length 309 can be made shorter than length 209. The effect of shortening 309 so that when the knob 306 is flush to warhead housing end 103 is that adjustable grid 300 cannot reach all the way into the warhead. The innermost length of the stationary grid 200 will not be screened any more by any portion of adjustable grid 300. The effect of this is the innermost (front end) of warhead 100 will generally produce larger sizes of fragments, than the portion of stationary grid 200 that is still screened by adjustable grid 300. In FIGS. 4A-4C, the general effect of positioning the grids might be illustrated. With like square patterns, a stationary grid in FIG. 4A is shown with square, mostly open gap areas 202 whereas an adjustable grid is shown here to have mostly closed square areas 303 in like patterns in FIGS. 4B and 4C. As closed areas 303 in FIGS. 4B and 4C hypothetically are slid over open areas 202, the open areas become blocked into smaller areas 202 shown there in FIGS. 4B and 4C. These smaller areas 202 will lead to differently sized and shaped fragments of the warhead housing 102 than the fully open areas 202 would have. It will be appreciated that many positions and size gaps may be achieved by rotating and sliding in or out, the adjustable grid 300. FIG. 5A may illustrate how an adjustable grid 300 may be rotated, (directions 504, 506), or pulled out (direction 505, e.g.), to achieve various gaps 503, 502, or blocked areas 502, e.g. It should also be remembered that the formed gaps on the grids 200, 300 may also be widely varied to produce different fragment sizes. The shapes of individual gaps can be widely varied (holes, parallelograms, curved shapes, etc.); the size of individual gaps (percentage of liner space as gap vs. solid, e.g.); the patterns of the gaps on the grids (fields of different cutouts as desired); and orientation of the patterns (turned 90 degrees from one another, e.g.) can all be altered to advantage in designing the ultimate warhead fragments. Another variation might be to provide an additional plastic liner, which is fully solid, disposed between the inside of housing 102 and adjustable grid 300, which can further influence the type, size, and shapes of ultimate fragments of exploding fragmentation warhead housing 102.

Figure 3:
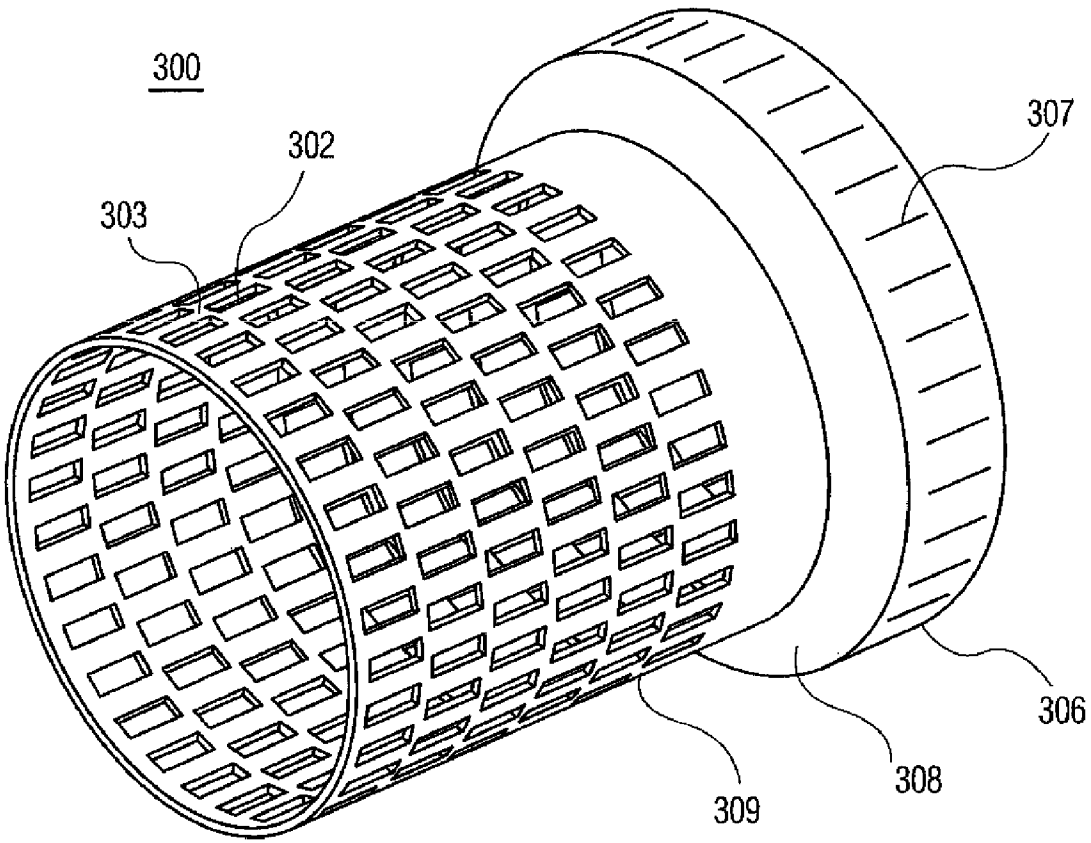
FIG. 3 shows an isometric view of an adjustable liner 300 with its grid system of open gaps, that in one embodiment of the invention is internal to the fragmenting warhead of FIG. 1, and in relatively tight assembly with an inner liner such as FIG. 2.
Figure 3A:
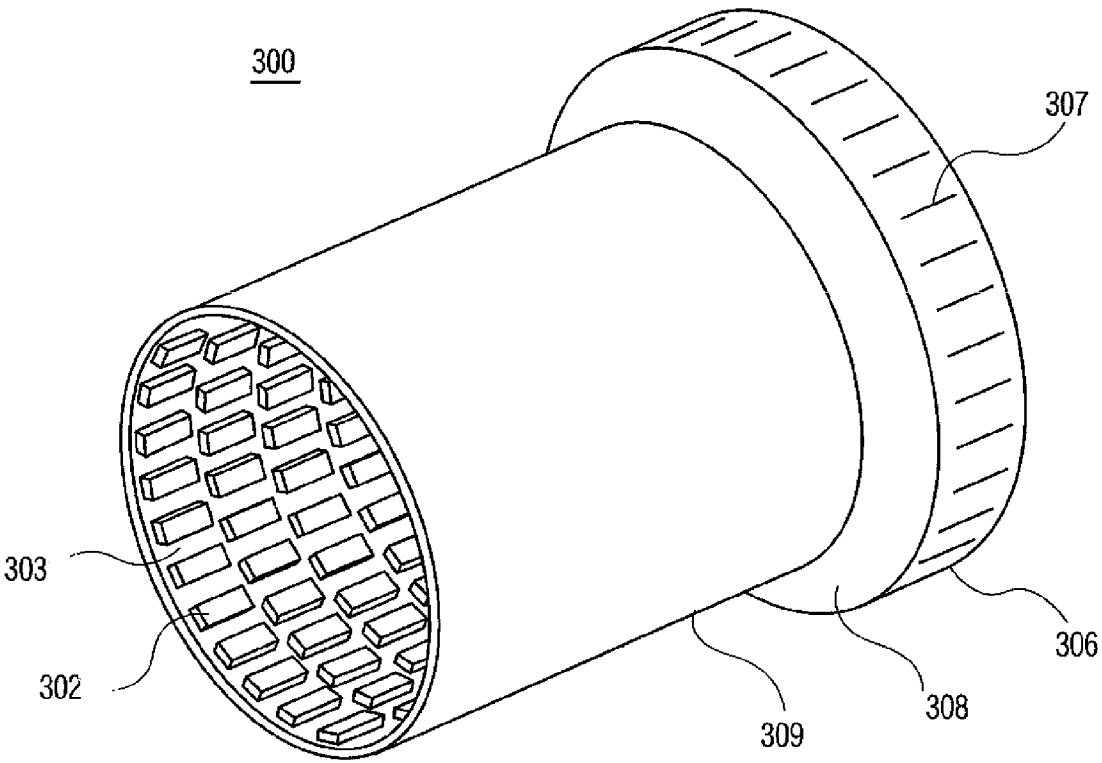
FIG. 3A shows an isometric view of another type of adjustable liner 300 (with its inner surface grid system of raised square bumps), that in another embodiment of the invention can be made internal to a fragmenting warhead, and in tight assembly with an inner liner such as FIG. 2A.

In FIG. 3A, the adjustable grid cylindrical liner 300 is now arranged to be smooth on the outside, but on its inside surface there is a checkerboard pattern of rectangular raised surfaces 302. The height of the raised surfaces is equal to about a thickness of the liner 300, so that a raised surface on the liner presents twice the thickness of a non-raised surface. The side of the square raised surface is about equal to one third the side length of a recessed area 202 in the stationary liner of FIG. 2A. The areas in between the raised surfaces are labeled as 303. Cylindrical liner 300 is meant to snugly envelop stationary liner 200, so that the rectangular raised surfaces 302 fit in to the recessed areas 202 in the stationary liner 200 since the height of the raised surfaces 302 is approximately equal to the depth of the recessed areas 202 in the stationary liner 200. It is possible for the raised surfaces 302 to be moved about within the recessed areas 202 in all directions, since as mentioned, the side of the square raised surface is about equal to one third the side length of a recessed area 202. The movement may be done by rotating adjustable grid 300 clockwise/counter-clockwise or by pulling out/pushing in of the adjustable grid 300, as may be desired. Moving about the raised surfaces 302 within the recessed areas 202 of course will influence the fragmentation patterns on warhead housing 102. An explosion pattern that encounters a raised surface 302 after passing through some part of stationary liner 200 will experience plastic material of three times the thickness of a liner; parts of the explosion that miss the (square) outline of a raised surface 302 will only experience material of two times the thickness of a liner (with air in between stationary liner 200 and adjustable grid liner 300 at those points).

While the invention has been described with reference to certain embodiments, numerous changes, alterations and modifications to the described embodiments are possible without departing from the spirit and scope of the invention as defined in the appended claims, and equivalents thereof.

What is claimed is:

1. A warhead with controlled fragmentation, comprising a cylindrical body and having a munition casing; said warhead comprising:

a concentric first cylindrical liner of plastic material that is formed in a predetermined pattern, said first cylindrical liner having an interior surface thereof;

a centrally located cylindrical explosive charge that is disposed within said first cylindrical liner, wherein said first cylindrical liner completely surrounds the explosive and wherein said explosive completely fills the interior space bordered by the interior surface of said first cylindrical liner;

a concentric second cylindrical liner of plastic material that is formed in a predetermined pattern, which second cylindrical liner is of a greater diameter to and which is positioned to moveably surround said first cylindrical liner, and;

wherein the concentric second cylindrical liner has on its interior surface, patterns including a plurality of raised bumps and a plurality of solid liner elements, wherein the raised bumps are interposed among the solid liner elements; and wherein the concentric first cylindrical liner include patterns which comprise a plurality of recessed areas and a plurality of solid liner elements, and wherein the recessed areas are interposed among the solid liner elements, and;

wherein upon detonation of the centrally located explosive charge, the detonation energy propagates outwardly from the central region of the munition, through the first and second liners toward the munition casing, thereby fragmenting the casing, and whereby detonation energy propagating through recessed areas of said first cylindrical liner are transferred more readily to the interior of the body, but the detonation energy propagating to the interior of the body after striking through solid liner elements of said first cylindrical liner and through raised bump areas of said second cylindrical liner are more dampened by such solid liner elements; and wherein such differences can cause the warhead body to shear and break into fragments with varied controlled sizes; and;

wherein, said second cylindrical liner may be axially rotated around said first cylindrical liner to influence the detonation energy propagating to the interior of the warhead body, whereby such rotation will ultimately even further affect fragment sizes of the fragmenting warhead due to relative depth of liner material experienced by detonation energy propagating in various locations due to random alignment of raised bumps, recessed areas, and solid areas whether in the first cylindrical liner or in the second cylindrical liner; and wherein the raised bumps on the concentric second cylinder interior are in a checkerboard pattern of rectangular raised surfaces of height equal to about a thickness of the concentric second cylindrical liner so that a raised surface on the liner presents twice the thickness of a non-raised surface, and wherein the rectangular shape is square, wherein each side of the square raised surface is about equal to one third the side length of a recessed area on the concentric first cylindrical liner, and wherein the rectangular raised surfaces fit in to the recessed areas in the concentric first cylindrical liner.

2. The warhead of claim 1, wherein the recessed areas are open to extend only partially through the depth of the liner to form a stepped configuration in the concentric first cylindrical liner.

3. The warhead of claim 2, wherein the liner is patterned in a checkerboard configuration.

4. The warhead of claim 2, wherein the recessed areas and the solid liner elements are uniform and equal in size.

5. The warhead of claim 2, wherein the recessed areas and the liner elements are square shaped.

6. The warhead of claim 2, wherein the recessed areas and the solid liner elements are diamond shaped.

7. The warhead of claim 1, wherein the liners are made of a low melt-temperature plastic material to facilitate heat-induced melt out, further enhancing ammunition resistance to fire hazards.

8. The warhead of claim 1, wherein the warhead includes any one of an explosively formed projectile and a shaped charge liner.

9. The warhead of claim 1, wherein the controlled size is selectable so as to allow a selectable fragmentation pattern with one or more desired fragment sizes that predetermined prior to deployment.

* * * * *